US007350594B2

(12) United States Patent
Cole et al.

(10) Patent No.: US 7,350,594 B2
(45) Date of Patent: Apr. 1, 2008

(54) SYSTEM AND METHOD FOR TRACKING AND COMMUNICATING WITH A BORING TOOL

(75) Inventors: Scott B. Cole, Edmond, OK (US); Bradley S. Marshall, Perry, OK (US); Michael R. Campbell, Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 0 days.

(21) Appl. No.: 11/612,311

(22) Filed: Dec. 18, 2006

(65) Prior Publication Data

US 2007/0102566 A1 May 10, 2007

Related U.S. Application Data

(63) Continuation of application No. 10/869,469, filed on Jun. 16, 2004, now Pat. No. 7,150,331.

(60) Provisional application No. 60/479,105, filed on Jun. 17, 2003.

(51) Int. Cl.
*E21B 44/00* (2006.01)
*E21B 47/02* (2006.01)

(52) U.S. Cl. ..... 175/45; 175/61; 33/313; 342/459; 324/329

(58) Field of Classification Search ..... 175/26, 175/40, 45, 57, 61, 62; 33/304, 313; 342/459; 324/329, 333, 346
See application file for complete search history.

(56) References Cited

U.S. PATENT DOCUMENTS 4,710,708 A 12/1987 Rorden et al.
4,881,083 A 11/1989 Chau et al.
5,568,162 A * 10/1996 Samsel et al. ..... 343/842
5,585,726 A * 12/1996 Chau ..... 324/326
5,621,325 A 4/1997 Draper et al.
5,633,589 A 5/1997 Mercer
5,767,678 A 6/1998 Mercer
6,315,062 B1 * 11/2001 Alft et al. ..... 175/45
6,414,629 B1 * 7/2002 Curcio ..... 342/357.08
6,435,286 B1 8/2002 Stump et al.
6,688,408 B2 2/2004 Barbera et al.

(Continued)

OTHER PUBLICATIONS

Digital Control Incorporated, DigiTrak® "Mark V Locating System", Operator's Manual, Aug. 2001.

(Continued)

*Primary Examiner*—Kenneth Thompson
(74) *Attorney, Agent, or Firm*—Tomlinson & O'Connell, PC

(57) ABSTRACT

A system for determining the location of and communicating with a downhole tool assembly. A tracker assembly comprises a vertical transmitting antenna, a plurality of receiving antennas, and a processor. The downhole tool assembly has a beacon assembly comprising a plurality of receiving antennas, a transmitting antenna, an orientation sensor, and a processor. The transmitter in the tracker transmits a substantially vertical dipole field. The beacon assembly detects the vertical field and processes the signals to determine the location of the beacon relative to the tracker. The beacon assembly transmits the beacon location and operational information to the tracker assembly. The tracker assembly displays the beacon location and operational information on a visual display. The tracker assembly may also transmit operational commands or requests for information to the beacon assembly.

8 Claims, 15 Drawing Sheets

U.S. PATENT DOCUMENTS

| | | | | |
|---|---|---|---|---|
| 6,717,410 | B2 | 4/2004 | Mizuno | |
| 6,719,069 | B2 | 4/2004 | Alft et al. | |
| 6,755,263 | B2 | 6/2004 | Alft et al. | |
| 6,886,644 | B2 | 5/2005 | Stump et al. | |
| 7,015,697 | B2 | 3/2006 | Brune et al. | |
| 7,150,331 | B2 * | 12/2006 | Cole et al. | 175/26 |
| 2005/0189143 | A1 | 9/2005 | Cole | |
| 2007/0044536 | A1 * | 3/2007 | Gunsaulis et al. | 73/1.79 |

OTHER PUBLICATIONS

Digital Control Incorporated, "DigiTrak® Mark V", Specification Sheet, Mar. 2004.

* cited by examiner

70
TEMPERATURE SENSING SECTION
62
TRANSMITTING SIGNAL SECTION
L4
C4
68
DSP MICROCONTROLLER SECTION
64
RECEIVING SIGNALS GAIN AND FILTER CIRCUITRY SECTION
RECEIVING ANTENNA
L3
C3
C2
L2
RECEIVING ANTENNA
C1
L1
66
GRAVITY SENSING SECTION
60
POWER REGULATION OUT SECTION (TO ALL DEVICES)
UT1 BATTERY

SYSTEM AND METHOD FOR TRACKING AND COMMUNICATING WITH A BORING TOOL

CROSS REFERENCE TO RELATED APPLICATION

This application is a continuation of U.S. application Ser. No. 10/869,469, filed Jun. 16, 2004 now U.S. Pat. No. 7,150,331, which claims the benefit of U.S. Provisional Application No. 60/479,105, filed on Jun. 17, 2003, the contents of which are incorporated herein fully by reference.

FIELD OF THE INVENTION

The present invention relates generally to the field of determining the location of underground objects, and more particularly to a system for communicating information between a tracker and a beacon assembly.

SUMMARY OF THE INVENTION

The present invention is directed to a tracking system for use in horizontal directional drilling. The tracking system comprises an above ground tracker assembly and a beacon assembly. The tracker assembly comprises a dipole field transmitter oriented in a substantially vertical plane, a tracker receiver arrangement comprising at least one receiving antenna, and a tracker processor. The beacon assembly comprises a beacon receiver arrangement comprising a plurality of receiving antennas orthogonally arranged and adapted to detect the dipole field transmitted from the tracker, an orientation sensor adapted to sense an orientation of the beacon assembly, a beacon processor, and a beacon transmitter. The beacon processor is adapted to determine the position of the tracker assembly with respect to the beacon assembly in response to the field detected by the beacon receiver arrangement and the orientation of the beacon assembly. The beacon transmitter is adapted to transmit a dipole field containing information related to the position of the tracker assembly. Further, the tracker receiver arrangement is adapted to detect the dipole field transmitted from the beacon transmitter and the tracker processor is adapted to determine the position of the beacon assembly with respect to the tracker assembly in response to the information contained in the dipole field detected by the tracker receiver arrangement.

In an alternative embodiment, the present invention is directed to a communication system for use in horizontal directional drilling. The communication system comprises an above ground tracker assembly and a beacon assembly. The tracker assembly comprises a dipole field transmitter oriented in a substantially vertical plane, a tracker receiver arrangement comprising at least one receiving antenna, and a tracker processor. The processor is adapted to provide data input to the transmitter and the transmitter is adapted to transmit a dipole field containing data representative of the input from the processor. The processor is further adapted to receive signals representative of a dipole field detected by the receiver arrangement and to extract data contained in the signals. The beacon assembly comprises a beacon receiver arrangement, a beacon transmitter, and a beacon processor. The beacon receiver arrangement is adapted to detect the dipole field transmitted from the tracker assembly and comprises at least one receiving antenna. The beacon processor is adapted to receive signals representative of the dipole field detected by the beacon receiver arrangement, extract data contained in the signals, and provide data input to the beacon transmitter in response to the data contained in the signals. The beacon transmitter is adapted to transmit a dipole field containing data representative of the input from the processor. Further, the tracker receiver arrangement is adapted to detect the dipole field transmitted from the beacon.

In yet another embodiment, the present invention is directed to a method for communicating information between a tracker and a beacon for use in horizontal directional drilling. The method comprises the steps of transmitting a substantially vertical dipole field from the tracker, detecting the vertical dipole field at the beacon, sensing an orientation of the beacon, determining a position of the beacon relative to the tracker in response to the dipole field detected at the beacon and the orientation of the beacon, transmitting from the beacon a dipole field containing the information related to the position of the beacon, and receiving at the tracker information related to the position of the beacon.

BRIEF DESCRIPTION OF THE DRAWINGS

FIG. 10 is a top view of an alternative embodiment of the present invention comprising multiple tracker assembly stations.

FIG. 11 is a plan view of the embodiment displayed in FIG. 10.

FIG. 13 is a flow chart illustrating the calibration process for the tracker assembly.

DETAILED DESCRIPTION OF THE PREFERRED EMBODIMENTS

Horizontal directional drilling ("HDD") permits the installation of utility services or other products underground in an essentially trenchless manner, eliminating surface disruption along the length of the project and reducing the likelihood of damaging previously buried products. A typical HDD borepath begins from the ground surface as an inclined segment that is gradually leveled off as the desired product installation depth is neared. The borepath follows the planned installation path and then inclines back to the surface to an exit point. The presence of previously buried products and the desire for graded installations has given rise to a need for methods and systems that allow for steering of a boring tool as it moves along the borepath.

To steer the boring tool, it is important to know the location and orientation (roll, pitch and yaw) of a downhole tool assembly at the end of a HDD drill string. Downhole tool assemblies generally comprise a steerable boring tool and a beacon assembly. Various beacon assemblies have been developed to provide the operator with information related to the location and orientation of the downhole tool assembly and the boring tool. Above ground trackers have been used to monitor the location and orientation of the downhole tool assembly. Generally, the tracker detects signals transmitted from the beacon assembly and determines the location and orientation of the boring tool from those signals.

The present invention provides the ability for the beacon assembly to determine the position of the tracker relative to the boring tool and communicate that information to the tracker. The present invention also provides the ability to communicate information between the tracker and the beacon assembly in response to a request from one or the other. While the preferred application of this invention is to near surface HDD, the systems and methods of this invention may be applied to other machines and devices which require knowing the location of a device, benefit from knowing the orientation of a device, or require communication with a device, such as, for example, a sewer locate system where the downhole assembly would still need to calculate its own orientation for calculations, but the information is not communicated to an operator.

Figure 1:
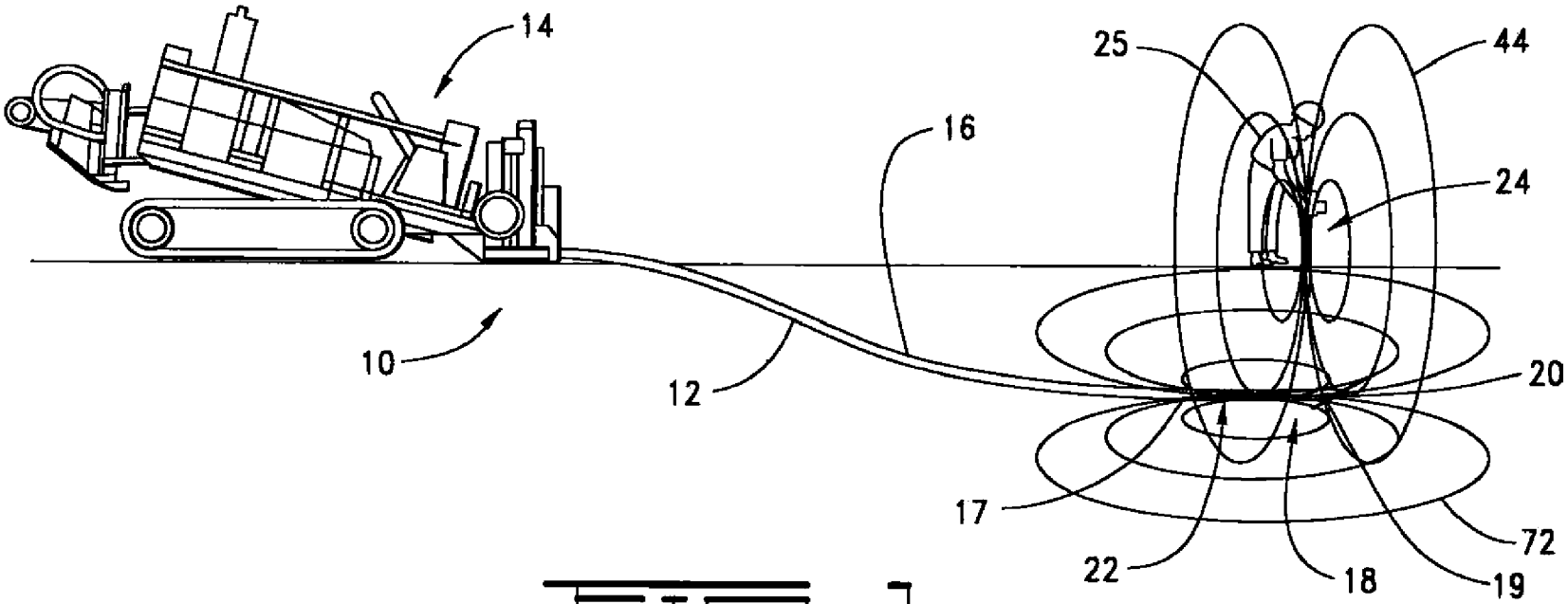
FIG. 1 illustrates a horizontal directional drilling machine and a tracking system for built in accordance with the present invention.

With reference now to the drawings in general and FIG. 1 in particular, there is shown therein a HDD system 10 suitable for the subsurface placement of utility services. FIG. 1 illustrates the usefulness of near surface HDD by illustrating that a borehole 12 can be made without disturbing an above-ground structure. The HDD system 10 comprises a drilling machine 14 for applying rotational and thrust forces to a drill string 16. A downhole tool assembly 18 is connected to a downhole end 17 of the drill string 16. The downhole tool assembly 18 preferably comprises a downhole tool 19 and a beacon assembly 22. Preferably, the downhole tool 19 comprises a directional boring tool 20. As used herein, directional boring tool 20 is intended to refer to any drilling bit or boring tool which may cause deviation of the tool from a straight path. A directional boring tool 20, when operated in accordance with the present invention, will have a steering capability to enable the downhole tool assembly 18 to direct the path of the borehole 12. The drilling machine 14 thrusts and rotates the drill string 16 to advance the boring tool 20 through the earth to create the borehole 12. While the invention will be described with reference to use with a boring tool 20, one skilled in the art will also appreciate that the invention would be equally applicable to use with other downhole tools 19, such as backreamers.

FIG. 1 also illustrates the present invention by showing the use of an above ground tracker assembly 24 to monitor the location and orientation of the downhole tool assembly 18. The present invention allows an operator 25 to quickly and accurately follow and direct the boring tool 20 throughout the bore 12. During the bore, the tracker assembly 24 of the present invention can obtain a variety of information at any time, such as the orientation, battery status, temperature, location, and depth of the downhole tool assembly 18, or thrust, torque, or pull forces on the downhole tool assembly.

Figure 2:
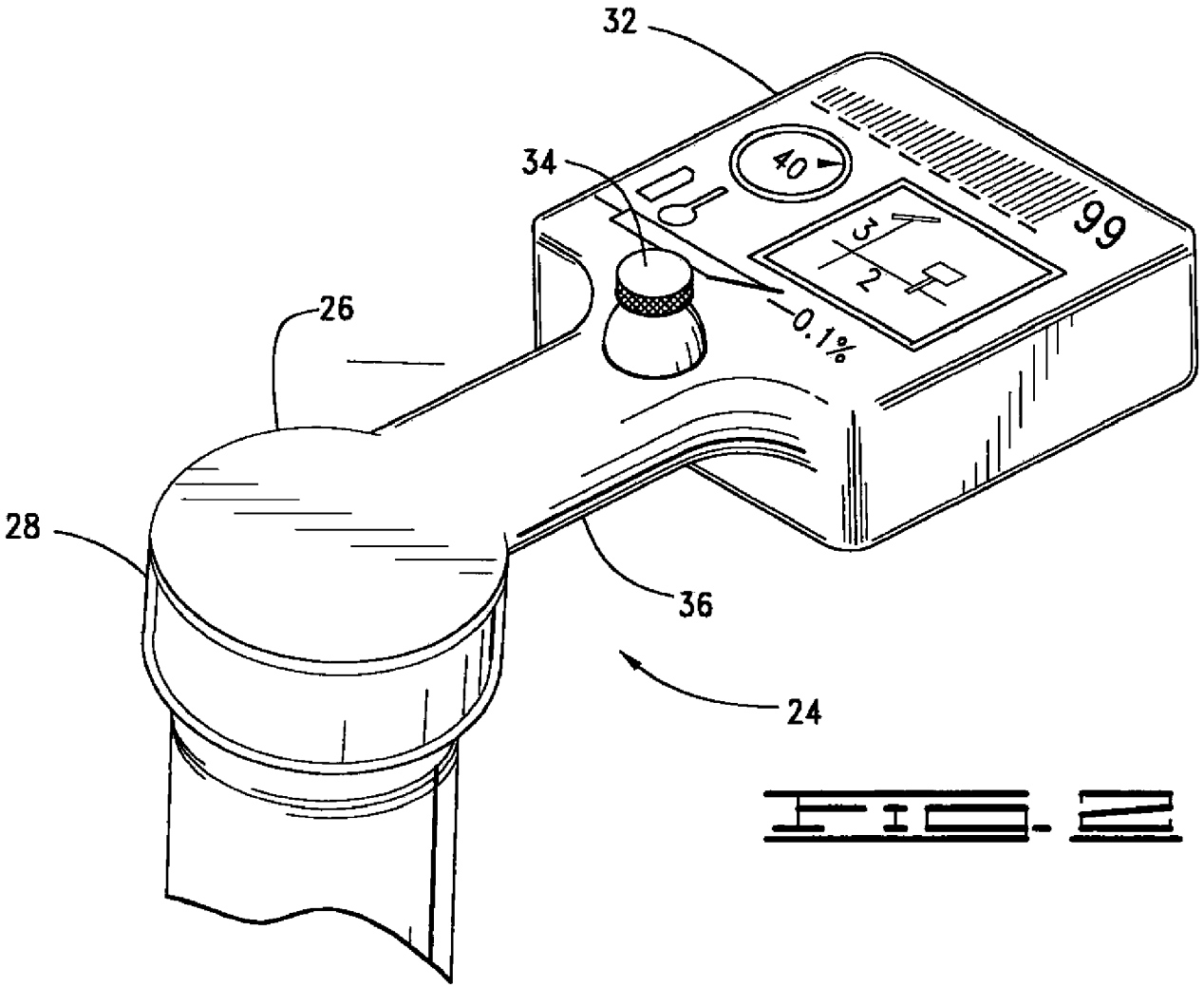
FIG. 2 shows a visual display and user interface for a tracker assembly of the tracking system.
Figure 3:
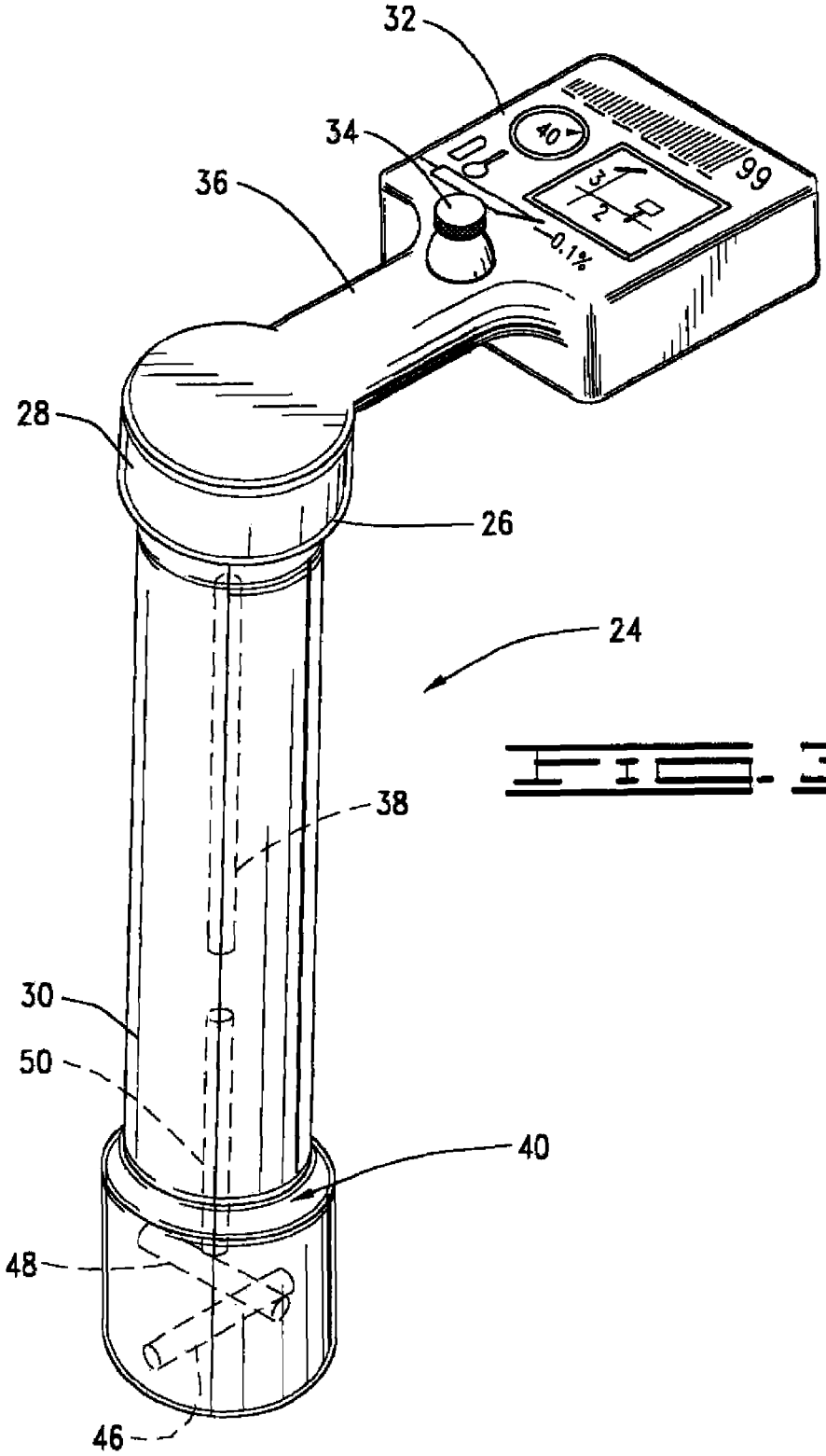
FIG. 3 shows a transmitter and receiver arrangement for the tracker assembly.
Figure 4:
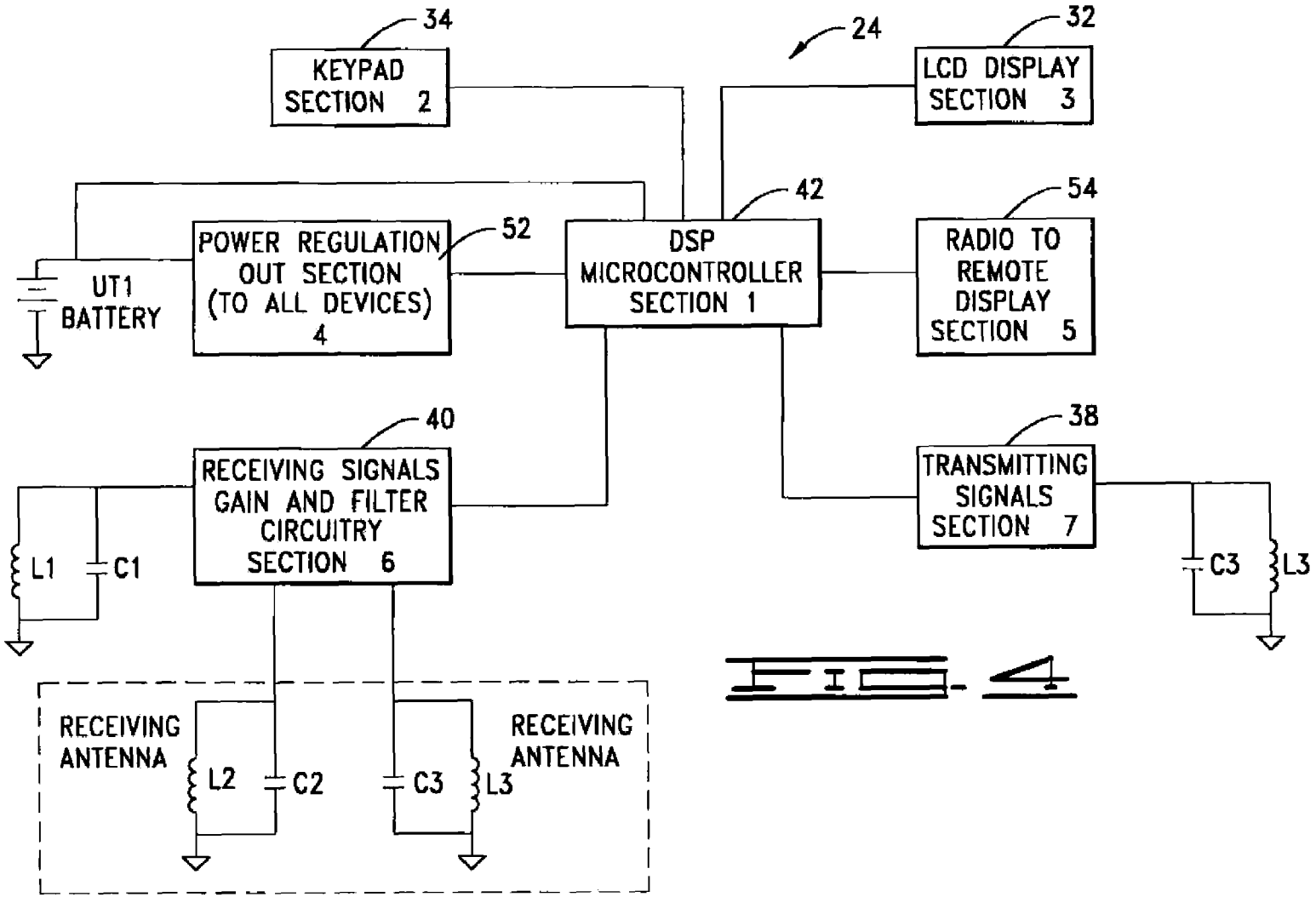
FIG. 4 is a block diagram for the tracker assembly.

With reference to FIGS. 2-4, the tracker assembly 24 is shown to have a frame 26 comprising a handheld unit having an upper portion 28 and a lower portion 30. Preferably, the upper portion 28 comprises a visual display 32, a user interface 34, and a handle 36 for carrying the tracker assembly 24. The lower portion 30 (shown in FIG. 3) preferably houses a transmitter 38, a receiver arrangement 40, and a processor 42 (shown in FIG. 4). The tracker assembly 24 may also comprise other electronics (not shown), such as a power supply.

With reference again to FIG. 2, the visual display 32, such as a liquid crystal display, is adapted to visually communicate various operational parameters to the operator 25, including the orientation of the downhole tool assembly 18. Preferably, the display 32 will show the orientation, battery status, temperature, location, and depth to the operator. The user interface 34 preferably comprises a plurality of buttons and a joystick, or other input devices, available for tracker manipulation.

Referring now to FIG. 3, there is shown therein the transmitter 38 and the receiver arrangement 40 for the tracker assembly 24. The transmitter 38 preferably comprises a transmitting antenna for transmitting a dipole field. The transmitting antenna 38 may comprise a coil wound on a ferrite rod. The antenna 38 is oriented substantially in a vertical plane and transmits a substantially vertical AC magnetic dipole field 44 (shown in FIG. 1). The field 44 can be modulated to communicate information as desired. The modulated or unmodulated dipole field 44 will be transmitted for receipt by a yet to be described receiver arrangement in the beacon assembly 22. As will be described further below, the transmitter 38 may also communicate information or a data request to the beacon assembly 22. One skilled in the art will appreciate that an unmodulated field may be used by the beacon assembly 22 for position (location and depth) determinations and a modulated field would be understood to contain communications from the tracker assembly 24.

The receiver arrangement 40 in the tracker assembly 24 comprises at least one receiving antenna adapted detect a magnetic field transmitted by a yet to be described transmitter in the beacon assembly 22. The receiver arrangement 40 communicates to the tracker processor 42 the detected magnetic field by outputting electrical signals representative of the field. In the preferred embodiment, the receiver arrangement 40 comprises a plurality of receiving antennas. Preferably, the receiver arrangement comprises first 46, second 48, and third 50 receiving antennas. More preferably, the first 46 and second 48 receiving antennas are oriented perpendicular to each other in a horizontal plane and the third antenna 50 is oriented in a vertical plane. At least one of the receiving antennas, the first receiving antenna 46 as shown in FIG. 3, is positioned in the same orientation as the beacon assembly 22. Use of three antennas 46, 48, and 50 allows the tracker assembly 24 to detect and resolve the dipole field from the beacon assembly 22 in any relative position. However, fewer antennas can be used in a communication system of the present invention. In an alternative embodiment, the receiver arrangement 40 may comprise only a single receiving antenna. In this alternative embodiment, the single receiving antenna should be placed in the same orientation as the first antenna 46 from the above embodiment, in a horizontal plane and parallel to the beacon assembly 22. The receiving antennas 46, 48 and 50, may individually comprise antennas with center-tapped coils including a ferrite rod to increase the magnetic flux through the coil. Antennas suitable for use with the present invention are described in U.S. Pat. No. 5,264,795, issued to Rider, the contents of which are incorporated by reference herein.

Alternatively, air cored antennas would also be suitable for use with the present invention.

The visual display 32, the user interface 34, the transmitter 38, and the receiver arrangement 40 are operatively connected to the tracker processor 42. The processor 42 receives input from the user interface 34, representing user requirements for tracker operation. The processor 42 also receives the electrical signals from the receiver arrangement 40. The processor 42 interprets the signals to determine the information transmitted by the beacon assembly 22. In response to the inputs from the user interface 34 and information from the beacon assembly 22, the processor 42 may make calculations for determining the position of the beacon assembly relative to the tracker. As will be discussed below, the calculations for determining the beacon 22 position are preferably made in the beacon but could alternatively be made by the tracker processor 42. The processor 42 will also communicate with the visual display 32 and the transmitter 38. Preferably, the communication with the transmitter 38 will comprise instructions for the field transmitted by the transmitter. In response to the instructions from the processor 42, the transmitter 38 may transmit a magnetic field for the beacon assembly 22 to determine the location of the tracker assembly 24. Alternatively, the transmitter may also transmit data requests, information and data, or operational commands to the beacon assembly 22.

With reference now to FIG. 4, there is shown therein a block diagram showing the relationships of the components of the tracker assembly 24. As discussed above, the processor 42, or DSP/Microcontroller, is operatively connected to the user interface 34, the visual display 32, the transmitter 38, and the receiver arrangement 40. Also as shown in FIG. 4, the tracker assembly 24 comprises a power regulation system 52 for providing power to the various components of the system. Preferably, power is supplied by a battery. FIG. 4 also shows an optional radio link 54 to a remote unit (not shown). The radio link 54 may be used where information from the tracker assembly 24 is sent to a remote station, such as at the drilling machine 14. The link 54 may comprise an RF antenna.

Figure 5:
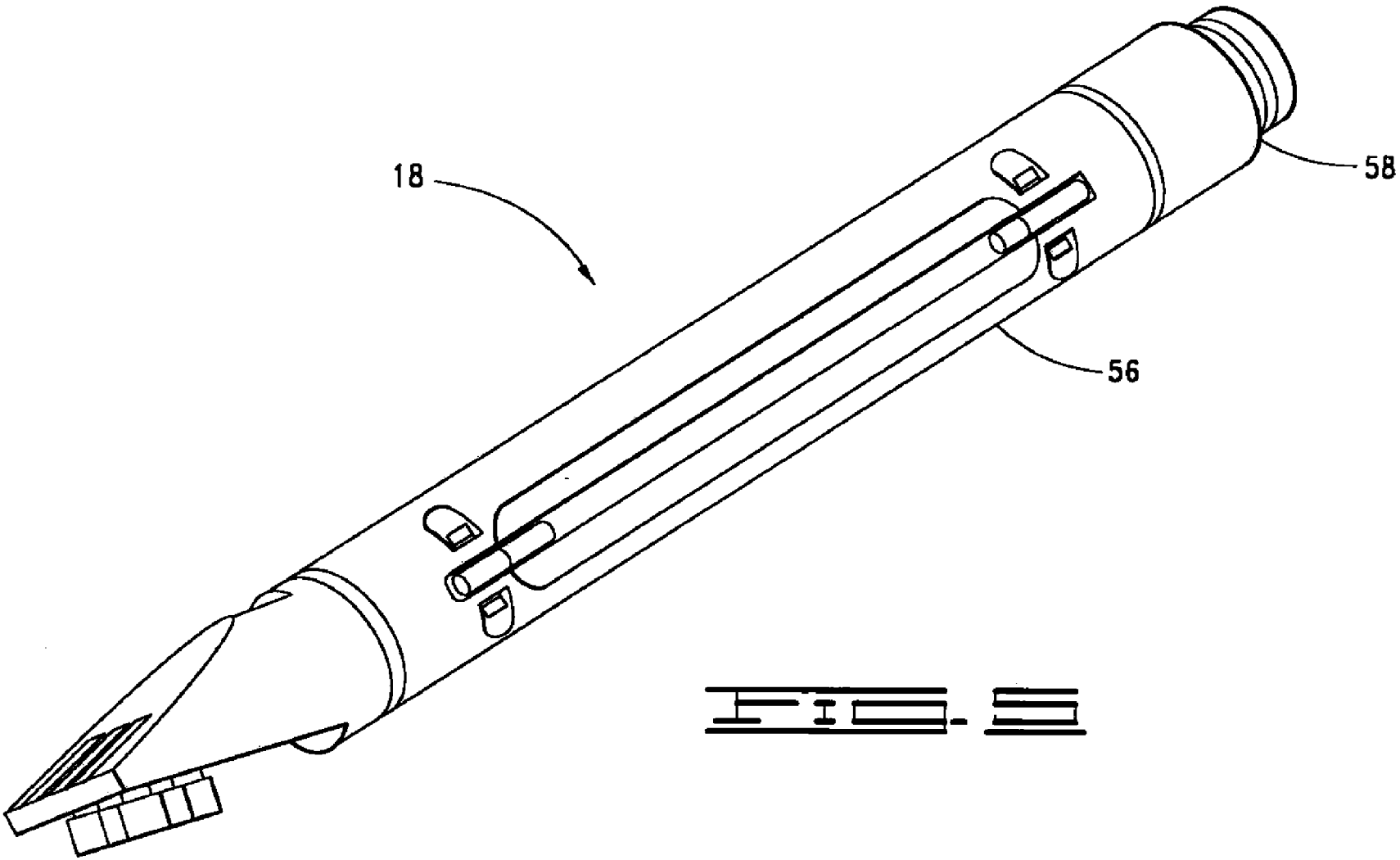
FIG. 5 illustrates a downhole tool assembly for use with the present invention.
Figure 6:
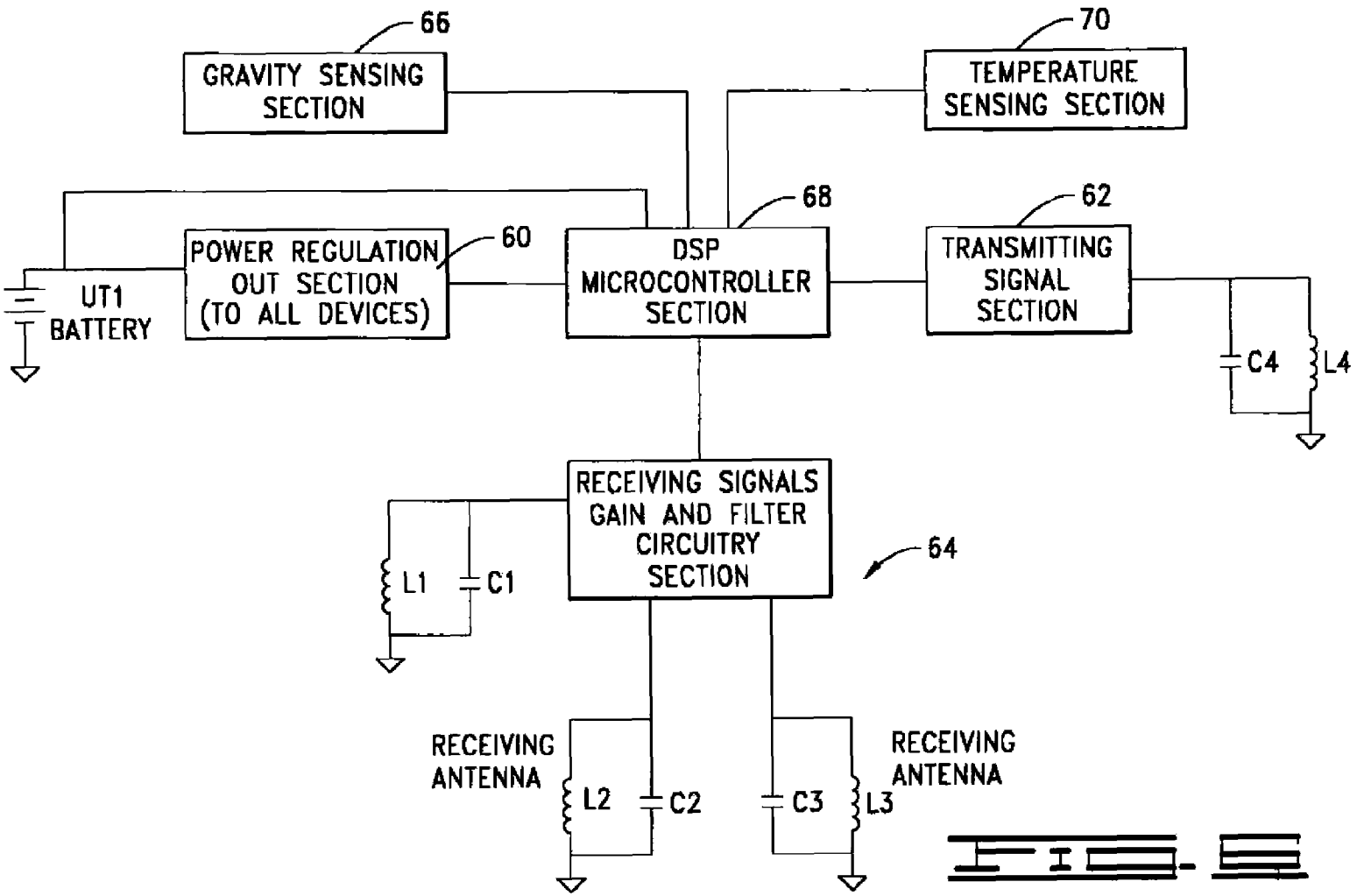
FIG. 6 is a block diagram for the beacon assembly of the present invention.
Figure 7:
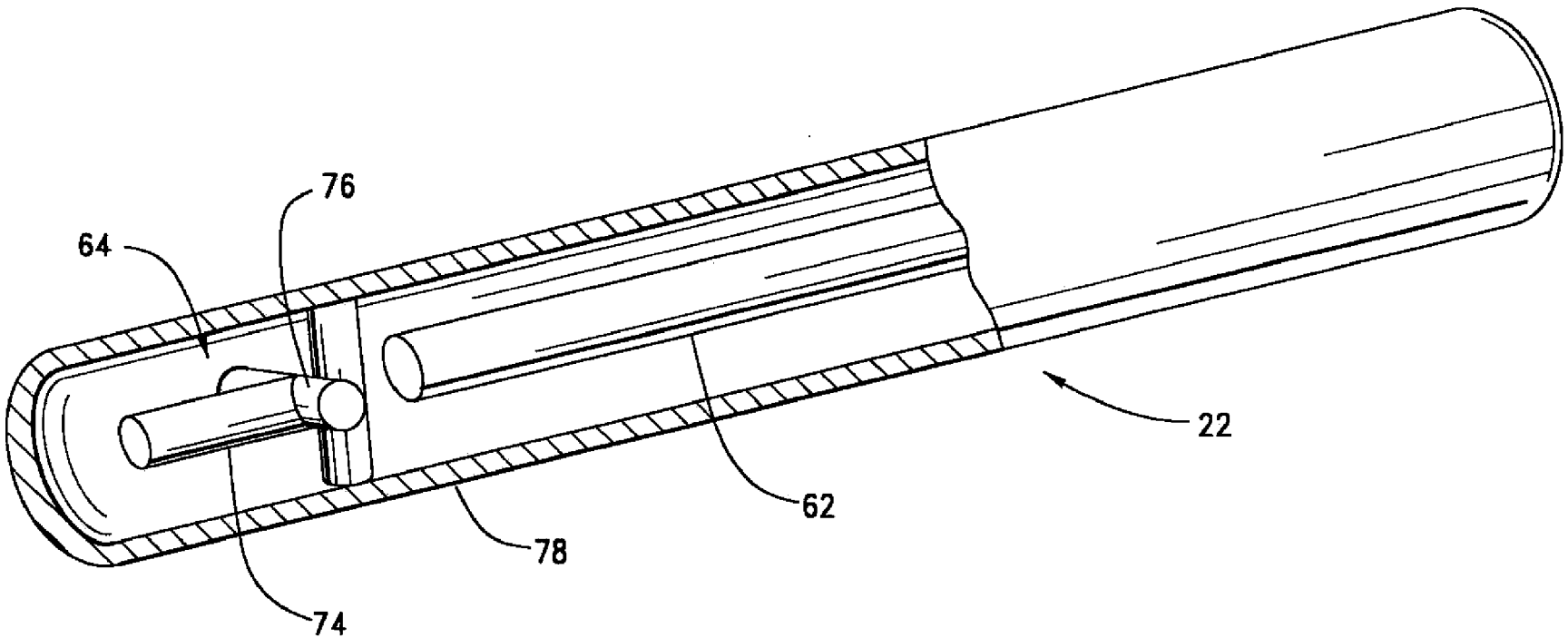
FIG. 7 illustrates a transmitter and receiver arrangement for the beacon assembly of the present invention.

Referring now to FIGS. 5-7, the beacon assembly 22 of the present invention is shown. The beacon assembly 22 is supported by the downhole tool assembly 18 as shown in FIG. 5. The downhole tool assembly 18 preferably comprises a housing 56 for supporting the beacon assembly 22. Preferably, the housing 56 is comprised of stainless steel, however, the housing may be constructed of other non-magnetic materials. The housing 56 is operably connected at the downhole end 17 of the drill string 16. Preferably, the connection between a rear end 58 of the housing 56 and the drill string 16 is a threaded connection.

Turning now to FIG. 6, there is shown therein a block diagram for a preferred embodiment of the beacon assembly 22 of the present invention. The beacon assembly 22 comprises a power system 60, an electromagnetic transmitter 62, a beacon receiver arrangement 64, an orientation sensor 66, and a processor 68. The power system 60 is used to provide power to the various components of the assembly 22. Preferably, power is supplied by a battery. Additionally, the beacon assembly 22 may comprise other electronics known in the art to sense various parameters of the beacon assembly 22, such as a beacon temperature sensor 70 or sensors for other parameters such as battery voltage, or thrust, torque, or pull forces on the downhole tool assembly 18.

The electromagnetic transmitter 62 of the beacon assembly 22 transmits an output signal. Preferably, the signal is a magnetic field 72 (shown in FIG. 1) that may be modulated to communicate information and data indicative of the position, orientation, and condition of the beacon assembly 22. With reference again to FIG. 6, the transmitter 62 is oriented along the axis of the beacon assembly 22 so that the magnetic field 72 is substantially horizontal. The magnetic field 72 transmitted by the transmitter 62 will be detected by the tracker receiver arrangement 40.

The receiver arrangement 64 for use with the beacon assembly 22 of the present invention is adapted to detect the magnetic field 44 transmitted by the transmitter 38 in the tracker assembly 24. The receiver arrangement 64 preferably comprises a plurality of antennas. More preferably, the receiver arrangement comprises first 74, second 76, and third 78 antennas. As shown in FIG. 7, the antennas are preferably oriented orthogonal to each other. In the orientation shown, the antennas 74, 76 and 78 will detect the orthogonal components of an electromagnetic field. In the present invention, the antennas 74, 76 and 78 detect the magnetic field 44 from the tracker assembly 24 and output electrical signals representative of the detected magnetic field.

The orientation sensor 66 may comprise one or more accelerometers adapted to sample changes in the angular orientation of the beacon assembly 22 in a known manner. For example, the orientation sensor 66 may comprise pitch or roll sensors that are capable of sampling data indicative of the pitch and roll orientation of the beacon assembly 22. Additionally, the orientation sensor 66 may also comprise a magnetometer or similar device for sensing the azimuth of the housing. Electrical outputs representative of the sensed orientation are communicated from the orientation sensor 66 to the beacon processor 68.

The beacon processor 68 is adapted to receive the electrical signals from the receiver arrangement 64 and the orientation information received from the orientation sensor 66. Further, the processor 68 is adapted to process the electrical signals received from the receiver arrangement 64 to determine the information transmitted by the tracker assembly 24. In response to the electrical signals and the orientation information, the processor 68 determines and calculates the position of the tracker assembly 24 relative to the beacon assembly 22. As used herein, the position determination will comprise the location of the tracker assembly 24 in a coordinate system having the tracker assembly 24 at the origin of the system. The position determination will preferably comprise the x, y, and z (vertical) coordinates of the tracker assembly 24. Alternatively, the beacon processor 68 may instruct the transmitter 62 to communicate the electrical signals to the tracker assembly 24 so that the calculations can be made by the tracker processor 42. Processing the data in the tracker 24 would permit the beacon processor 62 to allocate its processing time for other needed operations.

The processor 68 may also determine information or data requests (as yet to be described) transmitted by the tracker assembly 24, as contained in the electrical signals. In response to the information or data requests, the processor 68 may obtain information related to the operation of the beacon 22, from various sensors such as the orientation sensor 66 or temperature sensor 70, for transmission to the tracker 24. The processor 68 then communicates instructions to the transmitter 62 for communicating the information, by well-known amplitude, phase, or frequency modulation techniques, on the output signal 72 (shown in FIG. 1).

In the configuration of the preferred embodiment, as described above, the beacon assembly 22 and the tracker assembly 24 communicate and exchange information between the assemblies 22 and 24 using the respective transmitters and receiver arrangements. For determining the beacon assembly's 22 position and to transmit information, the tracker assembly 24 transmits the vertical dipole field 44 from its transmitter 38. The beacon receiver arrangement 64 receives the vertical field 44 and communicates representative electrical signals to the beacon processor 68. The beacon processor 68 processes the signals to determine if any information has been modulated on the field 44. Preferably, the beacon processor 68 also processes the signals, along with data received from the orientation sensor 66 and other sensors in the beacon assembly 22, to determine the position of the tracker assembly 24 relative to the beacon assembly. The beacon assembly 22 will then communicate the position information, and other information as requested or needed, using the beacon transmitter 62. Alternatively, the position calculation can be accomplished at the tracker assembly 24 and the beacon assembly 22 can merely transmit data and information.

The tracker receiver arrangement 40 detects the magnetic field 72 transmitted by the beacon transmitter 62, and communicates representative electrical signals to the transmitter processor 42. The tracker processor 42 processes the signals and communicates the position information and any other information received to the visual display 32. The tracker assembly 24 and the beacon assembly 22 can alternatively be arranged to communicate so that the beacon merely communicates the signals representative of the detected vertical field 44 to the tracker 24 for the tracker processor 42 to make the position determination and calculations. The tracker processor 42 also provides inputs to the transmitter 38 so that information or commands can be communicated by the tracker assembly 24 to the beacon assembly 22 on the vertical dipole field 44 during a next round of communications. One skilled in the art will appreciate the vertical dipole field 44 (shown in FIG. 1) transmitted by the tracker assembly 24 can be detected and resolved by the beacon receiver arrangement 64 at any relative position of the beacon assembly below ground. The system can be solved using known equations:

$$B_x = 3m \cdot \frac{x \cdot z}{(x^2 + y^2 + z^2)^{5/2}}$$

$$B_y = 3m \cdot \frac{y \cdot z}{(x^2 + y^2 + z^2)^{5/2}}$$

$$B_z = m \cdot \frac{2z^2 - x^2 - y^2}{(x^2 + y^2 + z^2)^{5/2}}$$

To determine the position of the beacon assembly 22 with the tracker assembly 24, the tracker will preferably be oriented such that the transmitting antenna 38 is in a vertical plane. while the tracker transmitter 38 is radiating a vertical dipole field 44, the receiver arrangement 40 of the beacon assembly 22 will detect the vertical dipole field and break the field into three orthogonal vectors. Using its knowledge of the gravity vector, or orientation, at the time, obtained with information from the orientation sensor 66, the beacon processor 68 can then break the field into x, y, and z coordinates. Preferably, the x, y, and z coordinates represent a position in a coordinate system having the tracker assembly 24 as the origin, the ground as the x-y plane, and the z direction being vertical (assuming the ground is horizontal). The beacon assembly 22 now sends this information on its transmitting field 72. The tracker assembly 24 then receives and displays the position information to the operator. One skilled in the art will appreciate the position information provides the operator the tracker assembly's 24 lateral offset from the beacon assembly 22 and the depth of the beacon assembly. Alternatively, simple direction information could be displayed by the tracker assembly 24. The direction information would allow the operator to know the direction to move in order to get closer to a point directly over the beacon assembly 22 and the boring tool 20. The process can then be followed until the operator is directly over the boring tool 20. In this manner, the boring tool 20 can be found in one step, with the tracker 24 directly overhead.

Figure 8:
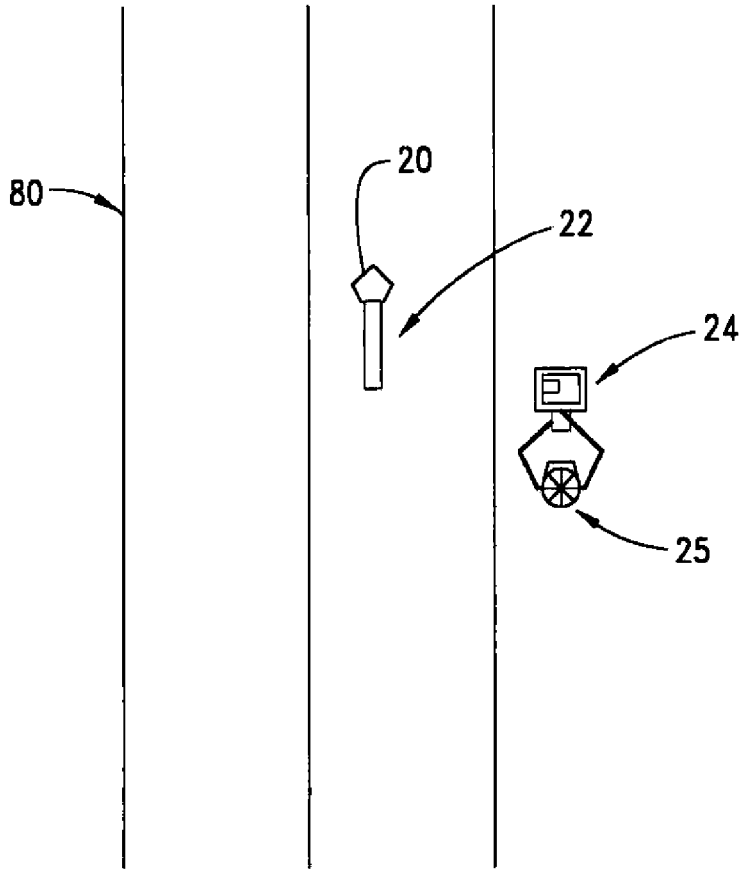
FIG. 8 shows a tracker assembly and beacon assembly built in accordance with the present invention.

One skilled in the art will appreciate the use of the vertical dipole field 44 transmitted by the tracker assembly 24 permits the beacon assembly 22 to determine the exact position of the tracker assembly in positions when the tracker is not directly over the boring tool 20. For example, as shown in FIG. 8, if the borehole 12 traverses under a busy road 80, a building, or other obstacle, and the boring tool 20 for a time is disposed beneath the road, the boring tool could be tracked with the tracker assembly 24 off to the side of the road. The bore 12 could then be followed and tracked by keeping the 'y' component, the distance of the tracker from the boring tool, constant. The capability of accurately determining the location of the boring tool 20 from an offset location has other advantages as well. For example, the system can be used to steer the boring tool 20 to a target point where the tracker assembly 24 is positioned, providing directional indicators for the operator to know which direction the tool must be steered to reach the target point.

As described above, the orientation sensor 66 in the beacon assembly 22 senses the gravity vector, or orientation, with respect to the beacon assembly and, consequently, the boring tool 20. This orientation information is used by the beacon processor 68 to determine the position of the tracker assembly 24, but can also be transmitted to the tracker for use by the tracker assembly. For example, in cases where the beacon assembly 22 is not aligned perfectly with the boring tool 20, the orientation information can be used to resolve ambiguities. If the boring tool 20 is placed on a perfectly level surface, for example, the orientation sensor in the beacon assembly 22 may read 1% up and 2° roll. To correct for this, the boring tool 20 can be placed in an orientation in which the operator would like the display to read as 0% pitch and 0° roll. A button on the user interface can be pressed so that the tracker assembly 24 will remember these settings. From that point forward, the beacon assembly 22 will send the sensed orientation information, and the tracker processor 42 will determine and instruct display of the boring tool's 20 orientation based on the orientation information and the correct user offsets.

Additionally, the beacon assembly 22 does not need to continuously send the orientation information to the tracker assembly 24. In some situations, the orientation of the boring tool 20 may not be needed. For example, if the drilling machine 14 is drilling quickly with continuous rotation and thrust, the roll of the boring tool 20 may be of little use to the operator. In this case, the temperature and location of the boring tool 20 are more useful to the operator, and should have a higher priority. The tracker processor 42, or the operator 25, can decide what information from the beacon assembly 22 is needed and can request that information from the beacon assembly. The tracker processor 42 communicates to the transmitter 38 the information to be contained on the transmitted vertical dipole field 44. In this way, the orientation information will only be transmitted to the tracker 24 upon request. It is also possible for the beacon 22 to determine pitch and roll before the gravity vector is sent to the tracker 24. If this were the case, a simple pitch and roll would be sent to the tracker 24. The tracker assembly 24 would not need to process any information other than simply displaying it to the operator.

The present invention also makes it possible for the tracker 24 to ask the beacon 22 specific questions, such as "are you at 0% pitch?" or "has pitch changed?" In this case, the beacon assembly 22 would only need to respond with a "yes" or "no." If the pitch had changed, the tracker assembly 24 would know what the last pitch was, and could quickly figure out the new pitch by asking it values close to the previous one. This would be beneficial in the case where the boring tool 20 is not moving. The beacon assembly 22 would not need to spend significant time modulating its transmitting field with data. This would free up much needed processing time to do other calculations.

The present invention also contemplates the heading of the boring tool 20 being determined by the tracker assembly 24. If the tracker receiver arrangement 40 comprises a single receiving antenna, for example, manipulation of the tracker 24 allows the operator to determine the boring tool's 20 heading. The tracker assembly 24 can be rotated until the greatest signal strength is shown on the display 32. At this point, the boring tool 20 is headed in the same direction as the receiving antenna of the tracker assembly 24. If the tracker receiver arrangement 40 has two perpendicular receiving antennas, the heading can be visually displayed to the operator and can be calculated by the tracker processor 42 by comparing the ratio of the signal strengths of the two receiving antennas. Alternatively, if the beacon assembly 22 were equipped with a compass, that information can be transmitted to the tracker assembly 24 for display the heading as yaw information.

The configuration and communication system of the present invention also provides advantages in determining the depth of the boring tool 20 and in calibrating the system. Both the tracker receiver arrangement 40 and the beacon receiver arrangement 64 are able to determine the field strength of the other's transmitted field. As with conventional systems, in order for the tracker assembly 24 to determine the depth of the beacon assembly 22 and the boring tool 20, the receiving antenna of the tracker receiver arrangement 40 must be placed in the same orientation as the beacon's transmitting antenna 62 and the tracker must be directly over the boring tool. However, the beacon assembly 22 can determine the distance to the tracker assembly 24 and, consequently, the depth of the boring tool 20, without regard to the relative position, using known equations.

Figure 9:
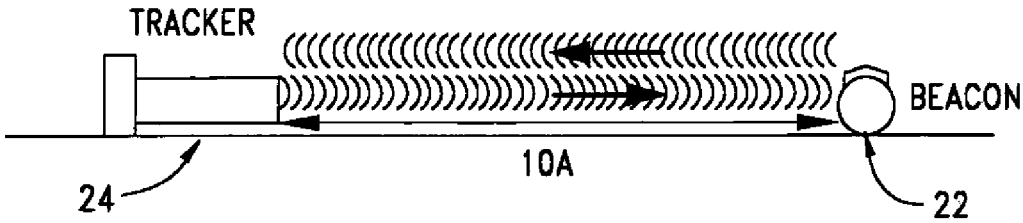
FIG. 9 shows an arrangement for calibrating the tracking system.
Figure 7:
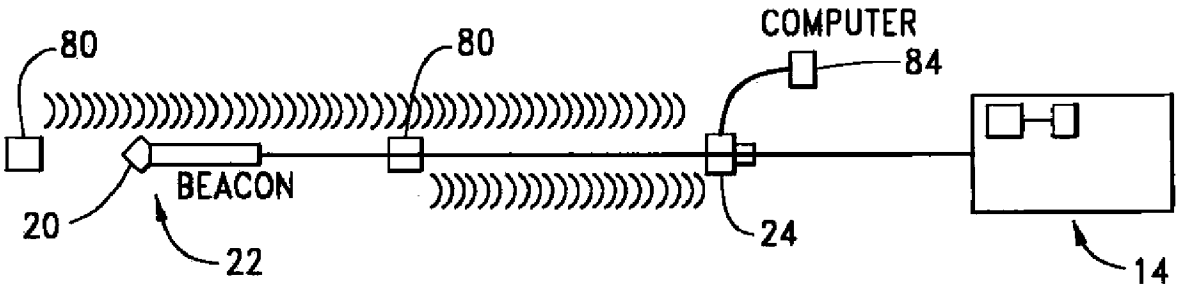
Figure 8:
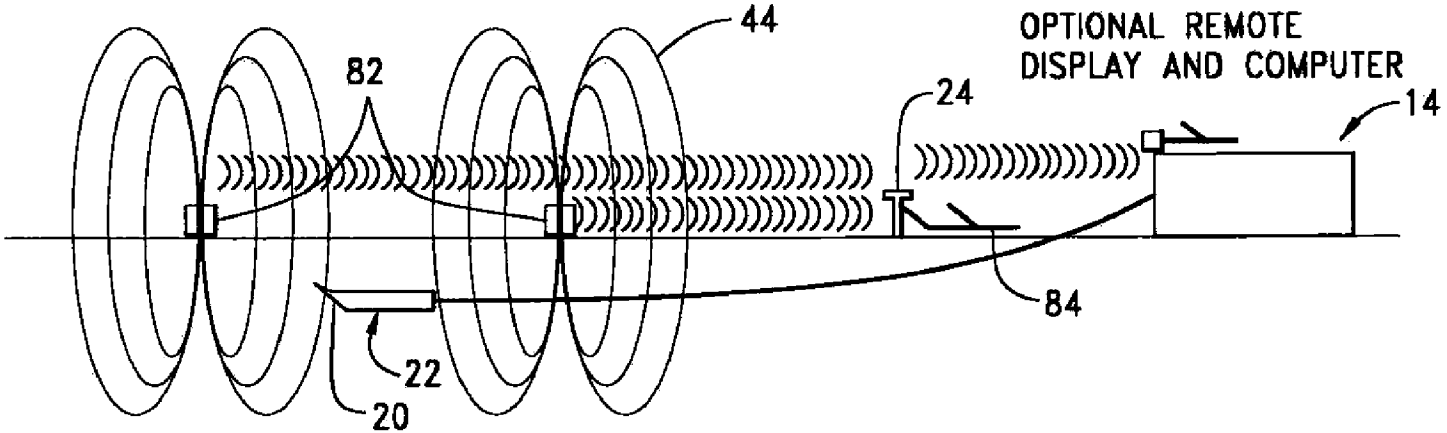

To properly determine the depth of the boring tool 20, the system must first be calibrated. The set up for calibration of the system is shown in FIG. 9. To calibrate the system, the user should first input the deepest anticipated depth of the bore and preferably the noise floor of the area. If the information is not known, a default value such as 50 feet could be used. The system should be set up with both the tracker assembly 24 and the beacon assembly 22 radiating their respective transmitting fields. The beacon assembly 22 must be inside the housing 56 to be used during the bore and the tracker 24 must be placed at a known distance from the housing (for example, 10 feet). Preferably, the tracker's transmitting antenna 38 should be pointed directly at and perpendicular to the housing 56, and the tracker's receiving antenna must be placed in the same orientation as the beacon's transmitting antenna 62.

The operator will now press a calibration button on the user interface 34 and the tracker processor 42 will instruct the transmitter 38 to communicate the deepest anticipated depth of the bore and preferably the noise floor of the area. Using the equation $H=m/d^3$ (equation 1), the tracker processor 42 and the beacon processor 68 will determine an appropriate 'm' value constant. The tracker processor 42 and the beacon processor 68 will select the appropriate m value from a table correlating m values with anticipated depths. The tracker assembly 24 and beacon assembly 22 will then communicate whether the tracker assembly 24 needs to increase or decrease its transmitting field power output. The tracker processor 42 will work with the transmitter 38 to adjust the transmitter output until equation 1 is satisfied in the beacon assembly 22 calculations. From this point forward, both the tracker assembly 24 and beacon assembly 22 will keep their transmitted field power constant. The depth can be calculated at both the tracker 24 and beacon 22 using equation 1. Since both can determine depth, the present invention represents a method for improving the reliability of and verifying the depth determination.

The present invention presents other advantages inherent in the ability to communicate information between the beacon assembly 22 and the tracker assembly 24. For example, the transmission frequency can be changed if necessary. Currently, many systems operate on a frequency of around 30 kHz. This frequency is prone to certain types of interference while other frequencies are not. With the system of the present invention, the beacon assembly 22 and the tracker assembly 24 can communicate to change both the transmitting frequency of the tracker transmitter 38 (for location and communication) as well as the frequency of the beacon transmitter 62 (for communication and depth verification) to any number of different frequencies. In order for this to happen, the user would need to input this desire at the tracker user interface 34. The tracker processor 42 would then communicate to the beacon processor 68 that the system should change to another frequency. Both the beacon processor 68 and the tracker processor 42 would also need to change their respective m values corresponding to the frequency change.

Another example of use of the communication process relates to power conservation or output. The beacon processor 68 could be used or instructed to change the power output level of the beacon transmitter 62. Alternatively, the beacon processor 68 may be programmed to put the beacon assembly 22 to sleep (in low power mode) after a certain period of inactivity. This period of time could easily be changed with the system of the present invention to be any length of time specified by the operator. Alternatively, the tracker 24 assembly may communicate instructions to disable the delayed sleep function telling the beacon processor 68 to go to sleep immediately. This would enable the operator to have the beacon 22 enter low power mode on command. The beacon 22 could also be immediately awakened by sending a command from the tracker 24.

In another embodiment of the invention, communications can be used to change the communication data rate. Often, due to the restraints of low signal/noise ratios at greater bore depths, the data rate for transmissions from the beacon assembly 22 is required to be low. If the signal/noise ratio was determined to be sufficient, however, the data rate could be increased. This would enable the system to update roll, pitch, yaw, location, etc at a much faster rate. With the present invention, the system can change the data rate to whatever the signal/noise ratio would allow. For example, a bore always begins at a shallow depth, which would allow the data rate to be relatively fast. As the bore continued and the boring tool was at a greater depth, the signal/noise ratio would get much less. The tracker processor 42 can communicate an instruction to the beacon assembly 22 to begin transmitting at a slower data rate. The tracker 24 would also need to switch to this new data rate. If the bore was at a point where the beacon 22 was at a great depth or in a high interference area, it may be necessary to lower the data rate even more. As the tool 20 head rose back to the surface, the data rates could be increased accordingly.

In an alternative embodiment, shown in FIGS. 10 and 11, the system of the present invention can be used with many smaller devices 82 that have the same antenna configuration 40 as the tracker assembly 24. These devices 82 can be placed along the bore path 12 and each radio-linked to the tracker assembly 24. As the bore progressed, the tracker 24 could turn on the device 82 in the closest proximity of the boring tool 20. The beacon assembly 22 would simply locate the active device 82 as if it were the tracker assembly 24 itself. As the active device 82 received communication from the beacon 22, the device would transmit this information to the tracker assembly 24, which would process and display the information to the operator. The tracker 24 could upload this information into a computer 84 to be used for bore mapping. If the tracker assembly 24 is equipped with a GPS system, the bore could also be related to the GPS coordinate system or the position of the beacon related to a geographic point or a GIS database. Since the tracker assembly 24 would know the bore path with the tracker as the origin, it could give the needed offsets to translate the bore path to the GPS coordinate system.

Figure 12A:
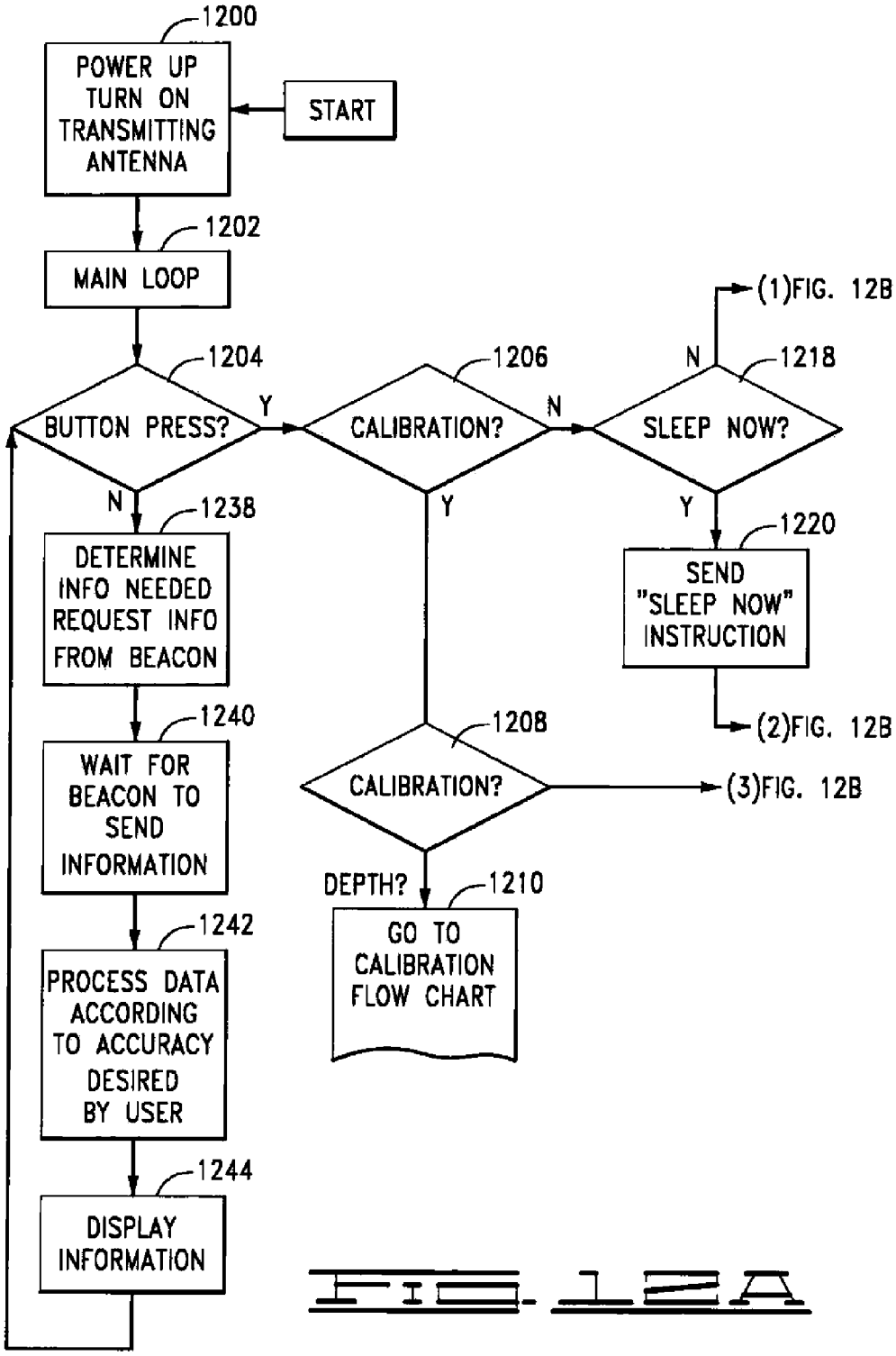
FIG. 12 is a flow chart for the tracker assembly processor.
Figure 12B:
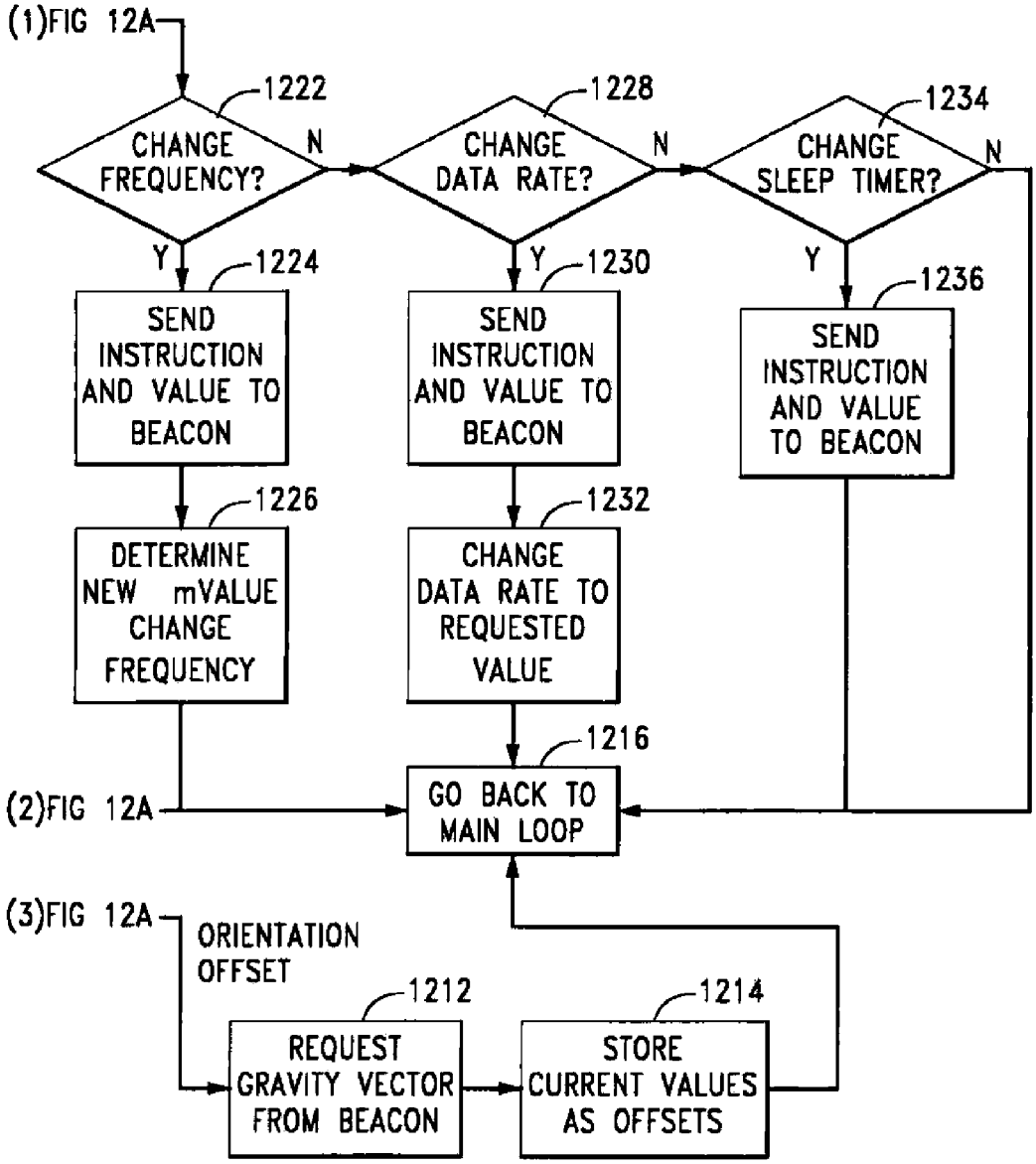
Figure 7:
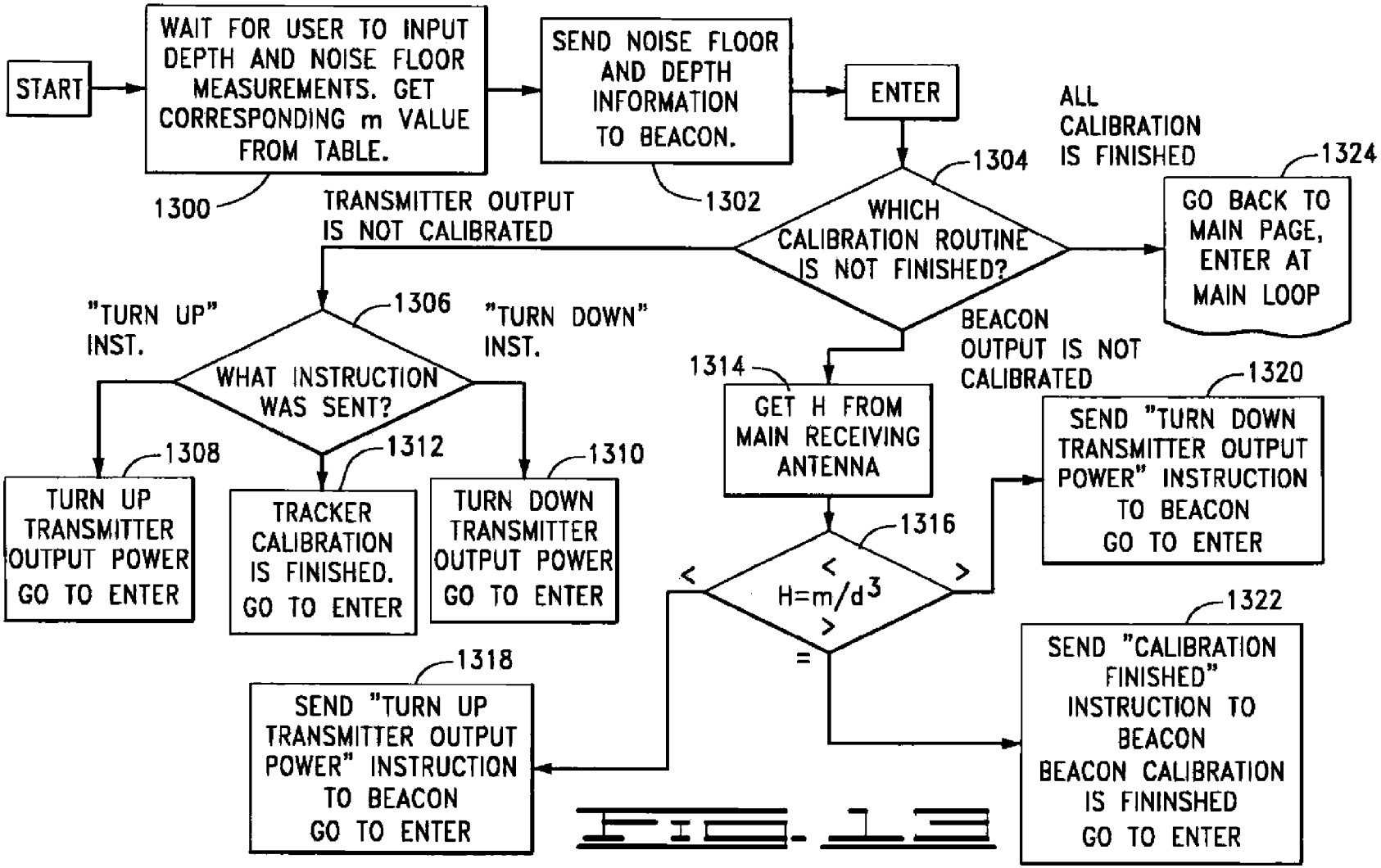

With reference now to FIG. 12, there is shown therein a flow chart for an algorithm followed by the tracker assembly processor 42. The algorithm begins at 1200 with the powering up of tracker components and turning on of the transmitter 38. At 1202 a main loop begins to check inputs the tracker is receiving. A check is made at 1204 to see if input has been received from the user interface, preferably in the form of a button press.

At 1206, a check is made to see if calibration is requested. If calibration is required, the processor 42 checks at 1208 to see which aspect of the system is to be calibrated. If depth is to be calibrated, the algorithm loops to the Tracker Calibration Routine at 1210. If instead the orientation offset is to be calibrated, at 1212 the processor 42 obtains the orientation information from the orientation sensor 66. At 1214, the orientation data obtained is stored as offset values for use in correcting future readings. The main loop is joined again at 1216.

The algorithm checks at 1218 to see if a request is made for the beacon to enter sleep mode. The sleep mode instruction is sent at 1220. The main loop is joined again at 1216.

If a change in transmission frequency is requested at 1222, an instruction and new frequency value is communicated to the beacon assembly 22 at 1224. The tracker processor 42 selects a new 'm' constant and the frequency of the transmitter 38 is changed at 1226. The main loop is joined again at 1216. Likewise, if a data rate change is requested at 1228, a comparable instruction and the rate value is sent to the beacon assembly 22 at 1230. The tracker processor 42 changes the transmitter 38 data rate at 1232. The main loop is joined again at 1216.

Finally, at 1234 a check is made to see if the sleep timer value is to be changed. A corresponding instruction and value are communicated to the beacon assembly 1236 to change the beacon's sleep value. The main loop is joined again at 1216.

Where no input from the user interface is received at 1204, the processor 42 makes a determination at 1238 to see what operational data or information is needed from the beacon assembly 22. At 1238, the processor 42 also communicates any information request to the beacon assembly 22. At 1240, the information from the beacon assembly 22 is received by the tracker receiver arrangement 40. The processor 42 extracts the information or data from the signals received by the receiver arrangement 40 at 1242. The information is displayed at 1244. The main loop is joined again at 1216.

Turning now to FIG. 13, there is shown therein the Tracker Calibration Routine for use with the present invention. At 1300, the algorithm begins by obtaining the anticipated depth and noise floor measurements from the user interface, and choosing the corresponding 'm' value. The depth and noise floor data is communicated to the beacon assembly 22 at 1302. At 1304, a check is made to see which calibration is still proceeding.

If the transmitter output is not yet calibrated, a check of the calibration instruction received is made at 1306. If the transmitter 38 is to increase power, the transmitter output is increased at 1308. If the transmitter 38 is to decrease power, the transmitter output is decrease at 1310. When the transmitter output calibration is complete at 1312, the routine returns to the loop of 1304.

If the beacon output is not yet calibrated, the magnetic field measurement 'H' is obtained from the receiver arrangement at 1314. At 1316, the output of the beacon transmitter 62 is checked. If the beacon transmitter 62 output needs to increase, the instruction is communicated at 1318. If the beacon transmitter 62 output needs to decrease, the instruction is communicated at 1320. When the beacon output calibration is complete at 1322, the routine returns to the loop of 1304. When all calibration is completed, the algorithm returns to the flow chart of FIG. 12 at 1324.

Figure 14A:
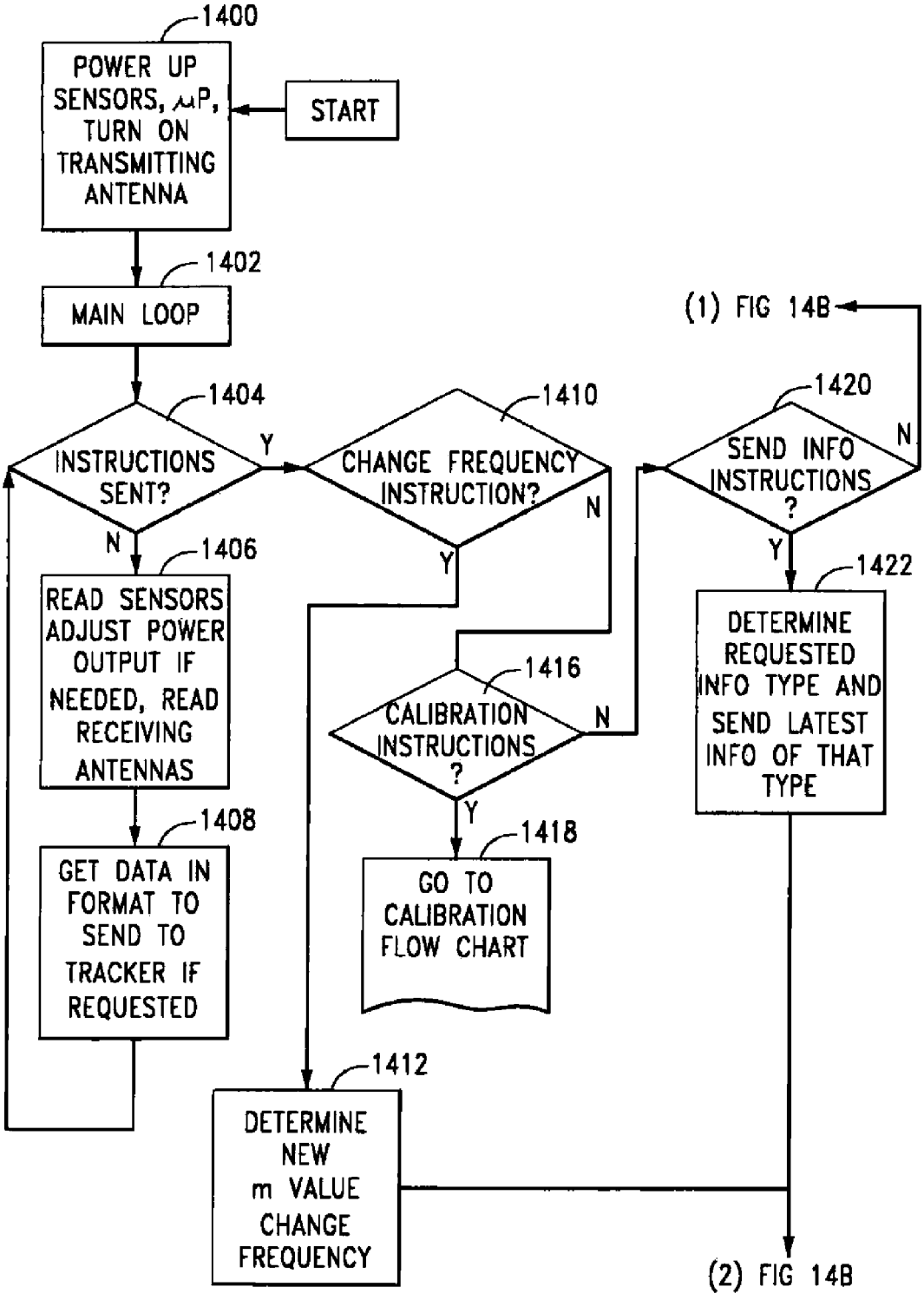
FIG. 14 is a flow chart for the beacon assembly processor.
Figure 14B:
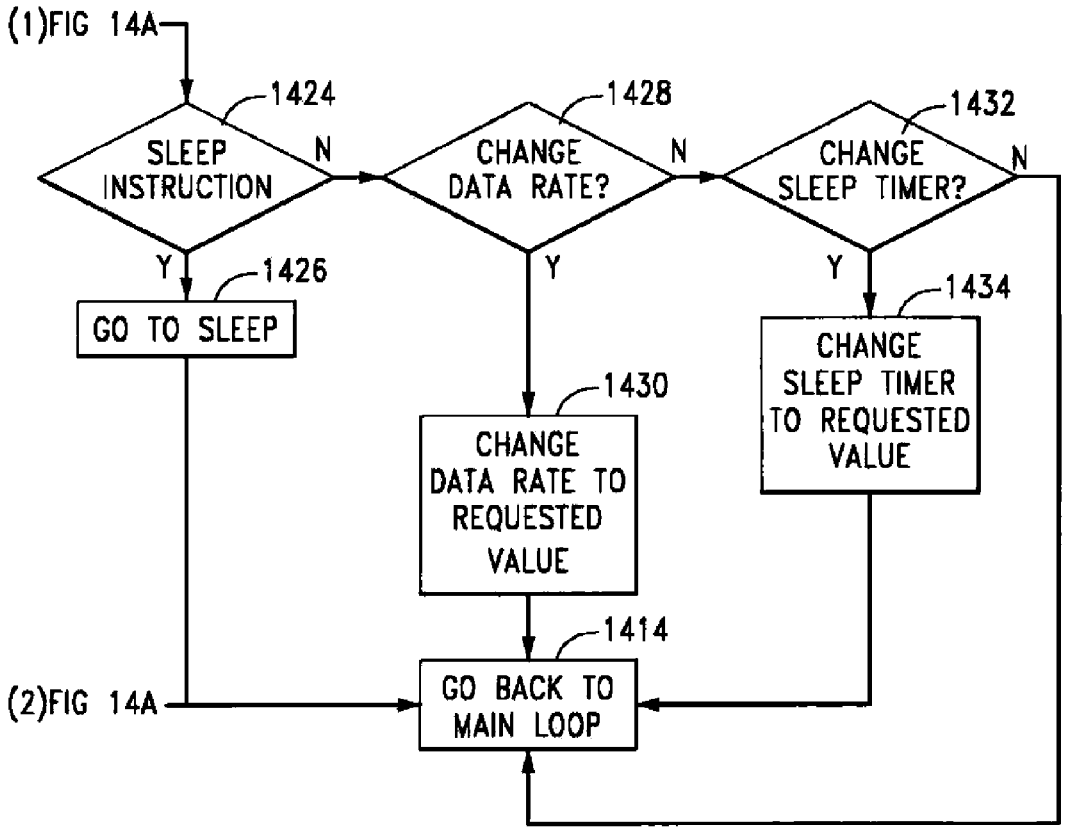

FIG. 14 illustrates a flow chart for the beacon processor 68 of the present invention. The algorithm begins at 1400 with the powering up of beacon components and turning on of the transmitter 62. At 1402 a main loop begins to check inputs the tracker is receiving. A check is made at 1404 to see if a request or instruction has been received from the tracker assembly 24 on the vertical dipole field 44. If no request or instruction was received, the various sensors in the beacon assembly 22 are checked and the receiver arrangement 64 signals received at 1406. At 1408, the position of the beacon assembly 22 is determined from signals and requested data is communicated to the transmitter 62. The main loop is joined again at 1402.

If a request or instruction is received at 1404, a check is made at 1410 to see if the frequency of transmission is to be changed. If a change is required, a new 'm' valued is selected and the frequency changed at 1412. The main loop is joined again at 1402. If a calibration instruction is received at 1416, the algorithm jumps to the Beacon Calibration Routine at 1418.

If specific information has been requested at 1420, the algorithm obtains the requested data and communicates the information to the tracker assembly 24 at 1422. If a sleep instruction is received at 1424, the beacon assembly 22 is commanded to a power saving mode at 1426. When a change data rate is requested at 1428, the transmission rate is changed at 1430. Finally, if an instruction to change the sleep time is received at 1432, the sleep timer value is changed at 1434. The main loop is joined again at 1414.

Figure 15:
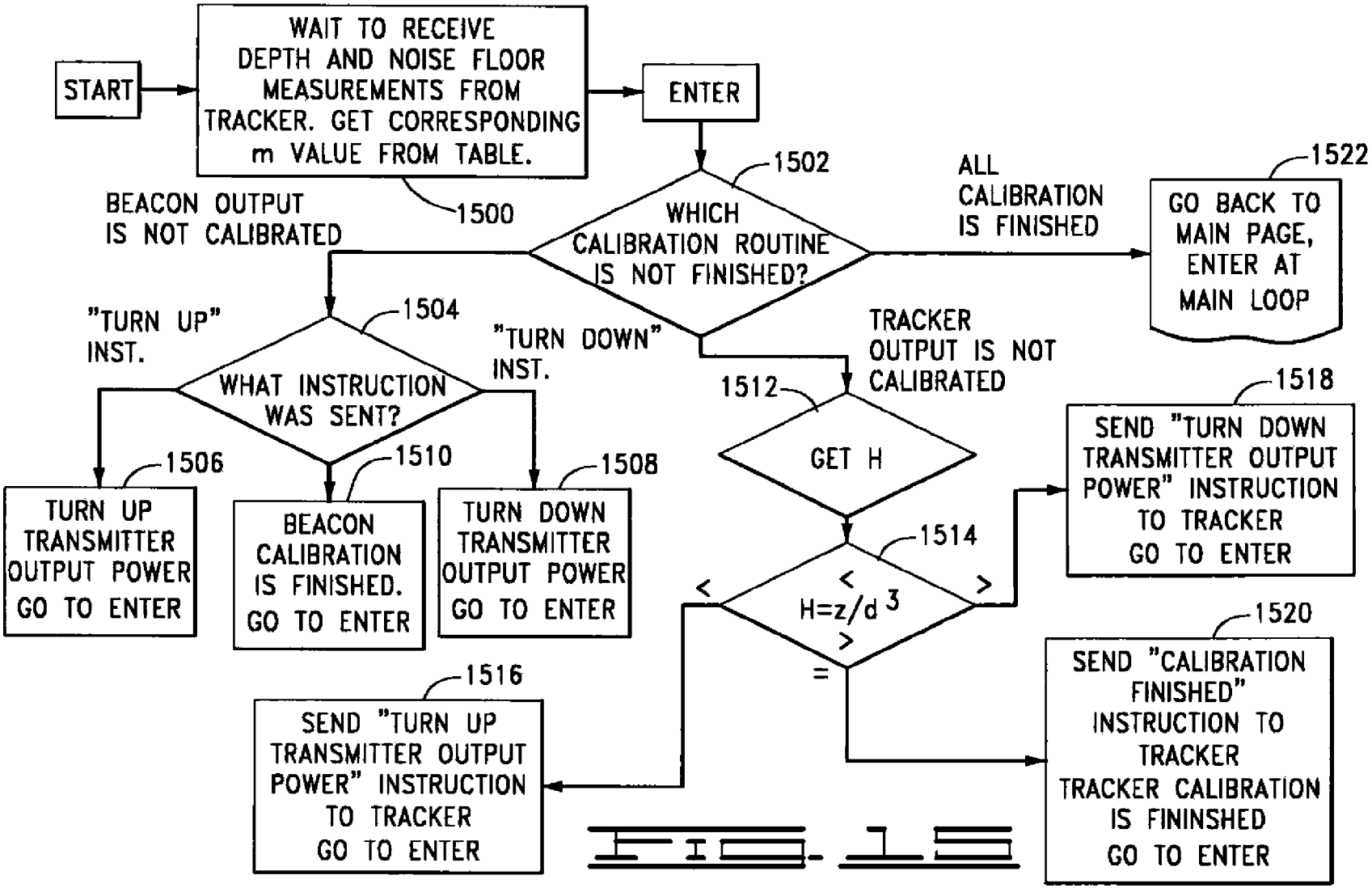
FIG. 15 is a flow chart illustrating the calibration process for the beacon assembly.

With reference now to FIG. 15, there is shown therein the Beacon Calibration Routine for use with the present invention. At 1500, the algorithm begins by obtaining the anticipated depth and noise floor measurements from the tracker assembly 24 as received on the vertical dipole field. The appropriate 'm' value is also chosen. At 1502, a check is made to see which calibration is still proceeding.

If the beacon transmitter 62 output is not yet calibrated, a check of the calibration instruction sent is made at 1504. If the transmitter 62 is to increase power, the transmitter output is increased at 1506. If the transmitter 62 is to decrease power, the transmitter output is decrease at 1508. When the transmitter 62 output calibration is complete at 1510) the routine returns to the loop of 1502.

If the tracker assembly 24 output is not yet calibrated, the magnetic field measurement 'H' is obtained from the receiver arrangement at 1512. At 1514, the output of the magnetic field value is checked. If the tracker transmitter 38 output needs to increase, the instruction is communicated at 1516. If the tracker transmitter 38 output needs to decrease, the instruction is communicated at 1518. When the tracker assembly 24 output calibration is complete at 1520, the routine returns to the loop of 1502. When all calibration is completed, the algorithm returns to the flow chart of FIG. 14 at 1522.

Those skilled in the art will appreciate that variations from the specific embodiments disclosed above are contemplated by the invention. The invention should not be restricted to the above embodiments and is capable of modifications, rearrangements, and substitutions of parts and elements without departing from the spirit and scope of the invention.

What is claimed:

1. A tracking system, comprising:

a tracker assembly comprising:

a signal transmitter;

a tracker receiver arrangement comprising at least one receiving antenna; and a tracker processor; and a beacon assembly comprising:

a beacon receiver arrangement adapted to detect the signal transmitted from the tracker, the beacon receiver arrangement comprising first, second, and third antennas oriented orthogonal to each other and adapted to output electrical signals representative of the detected signal;

a sensor adapted to sense an orientation of the beacon assembly; and a beacon signal transmitter;

wherein the beacon assembly determines position of the tracker assembly with respect to the beacon assembly in response to the tracker signal detected by the beacon receiver; and wherein the tracker receiver arrangement is adapted to detect signals transmitted from the beacon transmitter; and wherein the tracker processor is adapted to determine the position of the beacon assembly with respect to the tracker assembly in response to the information detected by the tracker receiver arrangement.

2. The system of claim 1 wherein the tracker receiver arrangement comprises a single antenna.

3. The system of claim 2 wherein the single antenna is positioned in a horizontal plane.

4. The system of claim 1 wherein the tracker receiver arrangement comprises first, second, and third antennas oriented orthogonal to each other.

5. The system of claim 1 wherein the sensor comprises an accelerometer and the orientation of the beacon assembly comprises a roll of the beacon assembly.

6. The system of claim 1 wherein the tracker assembly further comprises a visual display and wherein the beacon transmitter is further adapted to transmit a dipole field containing information related to the orientation of the beacon assembly; and wherein the tracker processor is further adapted to determine the orientation of the beacon assembly in response to the information contained in the dipole field detected by the tracker receiver arrangement and to display the orientation information at the visual display.

7. The system of claim 1 wherein the tracker assembly further comprises a visual display and wherein the tracker processor is further adapted to display the position of the beacon assembly at the visual display.

8. The system of claim 1 wherein the tracker processor is further adapted to calculate the depth of the beacon assembly in response to the signal from the beacon detected by the tracker receiver arrangement.

* * * * *